United States Patent [19]

Lebensfeld

[11] 3,949,520

[45] Apr. 13, 1976

[54] PARACHUTE TOY

[76] Inventor: Steven Allen Lebensfeld, 82-56 213th St., Queens Village L.I., N.Y. 11427

[22] Filed: Dec. 19, 1974

[21] Appl. No.: 534,369

[52] U.S. Cl. ..... 46/86 R
[51] Int. Cl.[2] ..... A63H 33/20
[58] Field of Search ..... 46/86 R, 86 A, 86 B, 86 C

[56] References Cited

UNITED STATES PATENTS

| | | | |
|---|---|---|---|
| 3,233,360 | 2/1966 | Poplin | 46/86 R |
| 3,397,481 | 8/1968 | Boese | 46/86 R |

*Primary Examiner*—Louis G. Mancene
*Assistant Examiner*—Robert F. Cutting
*Attorney, Agent, or Firm*—Edward F. Levy

[57] ABSTRACT

A parachute toy includes a canopy attached to a plurality of shroud lines which are attached to a swivel which is attached, in turn, by way of a single line, to a hinged hollow ball. The hinged hollow ball is adapted to be closed and thrown high into the air with the canopy, lines and swivel contained in wrapped condition therein. The hinged hollow ball opens during flight releasing the canopy as a result of air entering through a series of openings and also as a result of opening forces contributed by the canopy which is compressed within.

6 Claims, 8 Drawing Figures

FIG. 1
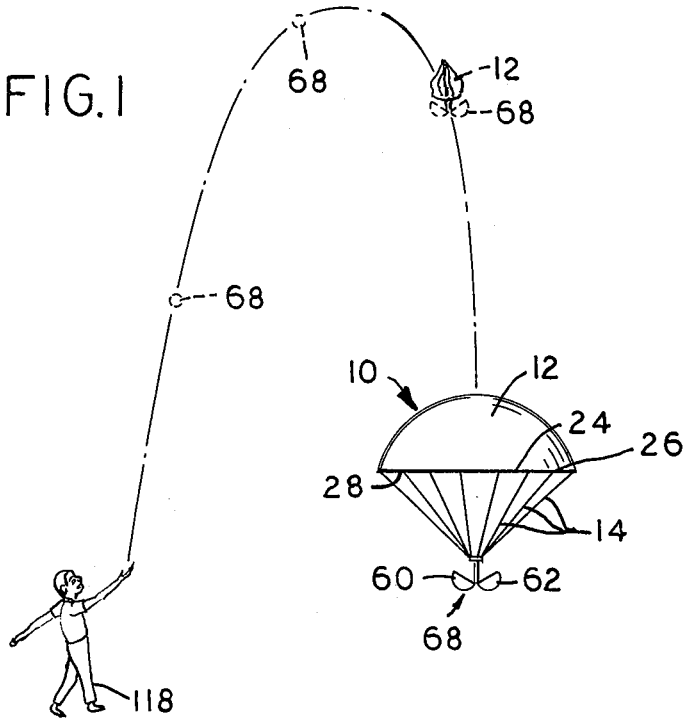
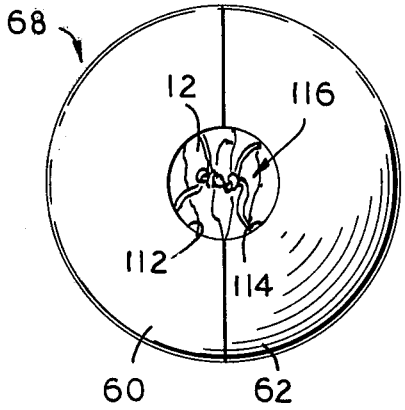
FIG. 2
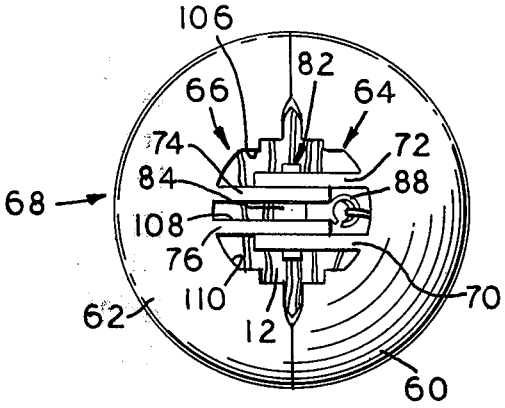
FIG. 3
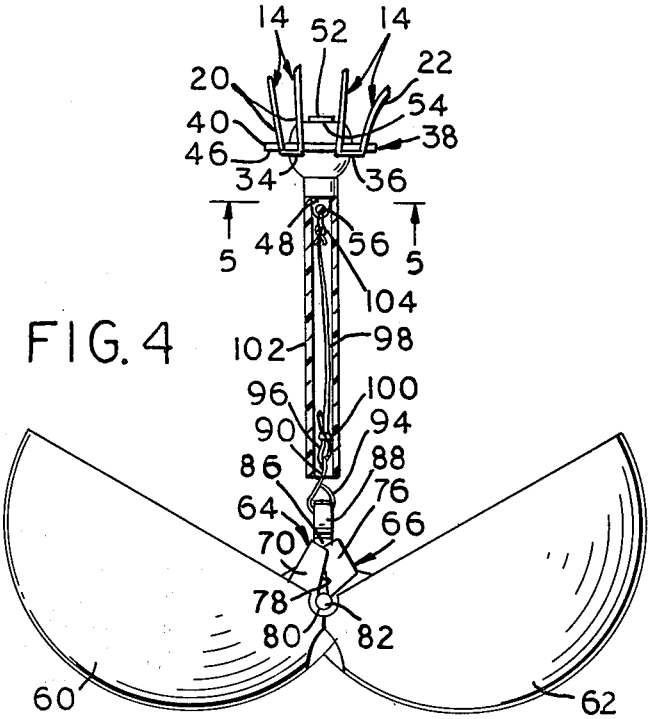
FIG. 4
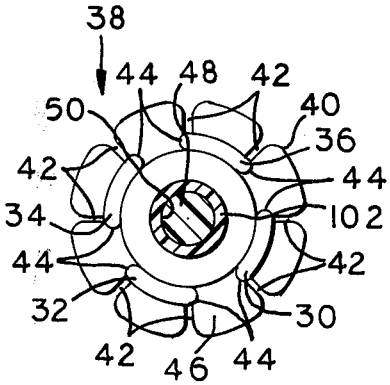
FIG. 5

PARACHUTE TOY

The present invention relates to toys in general and more particularly to a novel parachute toy.

Conventional parachute toys comprise a fabric canopy having a plurality of lines attached to the edge of the canopy and leading to a weight. In use, the weight is tossed into the air with the canopy trailing, or with the canopy and the lines folded about the weight. If properly thrown, the canopy opens and the parachute floats back to earth.

Among the disadvantages of the conventional parachute toy is the requirement for folding the canopy and the lines in order to reduce the aerodynamic drag to the point where the parachute toy can be thrown upward to a satisfactory height. This requirement leads to folding the canopy tightly and often results in a failure of the canopy to open properly. In addition, the folded canopy and lines form, at best, a relatively soft irregular object which can be thrown upward to a satisfactory height only with great difficulty, thus detracting from the enjoyment of the toy.

The present invention overcomes the disadvantages of the prior art by providing a novel parachute toy which comprises a canopy attached by means of a plurality of lines to a hinged hollow ball which serves as a weight. In use, the canopy and the lines are loosely placed into the hollow ball, the hollow ball is closed and the parachute toy is thrown upward. The outer surface of the hollow ball presents a smooth aspect having relatively low aerodynamic drag thus permitting the parachute toy, in accordance with the present invention, to be thrown to a height substantially greater than a conventional parachute toy. Close to the apogee of the trajectory of the parachute toy the effect of air entering the hollow ball through several openings, and the resilience of the folded canopy which is compressed within the hollow ball, results in the opening of the hollow ball thus allowing the canopy to fill with air and the parachute toy to settle slowly back to earth.

In a preferred embodiment of the present invention the plurality of lines are attached to a swivel and a single line leads from the swivel to the hinged hollow ball. The single line passes through a hollow resilient tube which has a length slightly greater than the internal diameter of the hollow ball. The resilient tube is bent to fit within the hollow ball during the operation of placing the canopy and the lines into the hollow ball. The resilient tube aids in the opening of the hinged ball and in addition aids in preventing tangling of the lines during the use of the parachute toy.

It is an object of the invention to provide a parachute toy including a hollow ball into which the canopy and lines can be placed prior to throwing the parachute toy in an upward direction.

Another object of the invention is to provide a parachute toy which can easily be thrown to a relatively great height.

Still another object of the invention is to provide a parachute toy which can be easily manufactured at a relatively low cost.

Additional objects and advantages of the invention will become apparent during the course of the following specification when taken in connection with the accompanying drawings, in which:

FIG. 1 is a perspective view, not to scale, showing the path of travel of the parachute toy during use, and the sequential positions of the toy during flight;

FIG. 2 is a top plan view of the parachute toy with the canopy and lines folded into the hollow ball and with the latter in closed position;

FIG. 3 is a bottom plan view of the parachute toy, with the ball in the closed position of FIG. 2;

FIG. 4 is a fragmentary side elevational view of the parachute toy with the hollow ball shown in the open position and the parachute parts extending therefrom;

FIG. 5 is an enlarged section taken along the line 5—5 of FIG. 4;

Figure 6:
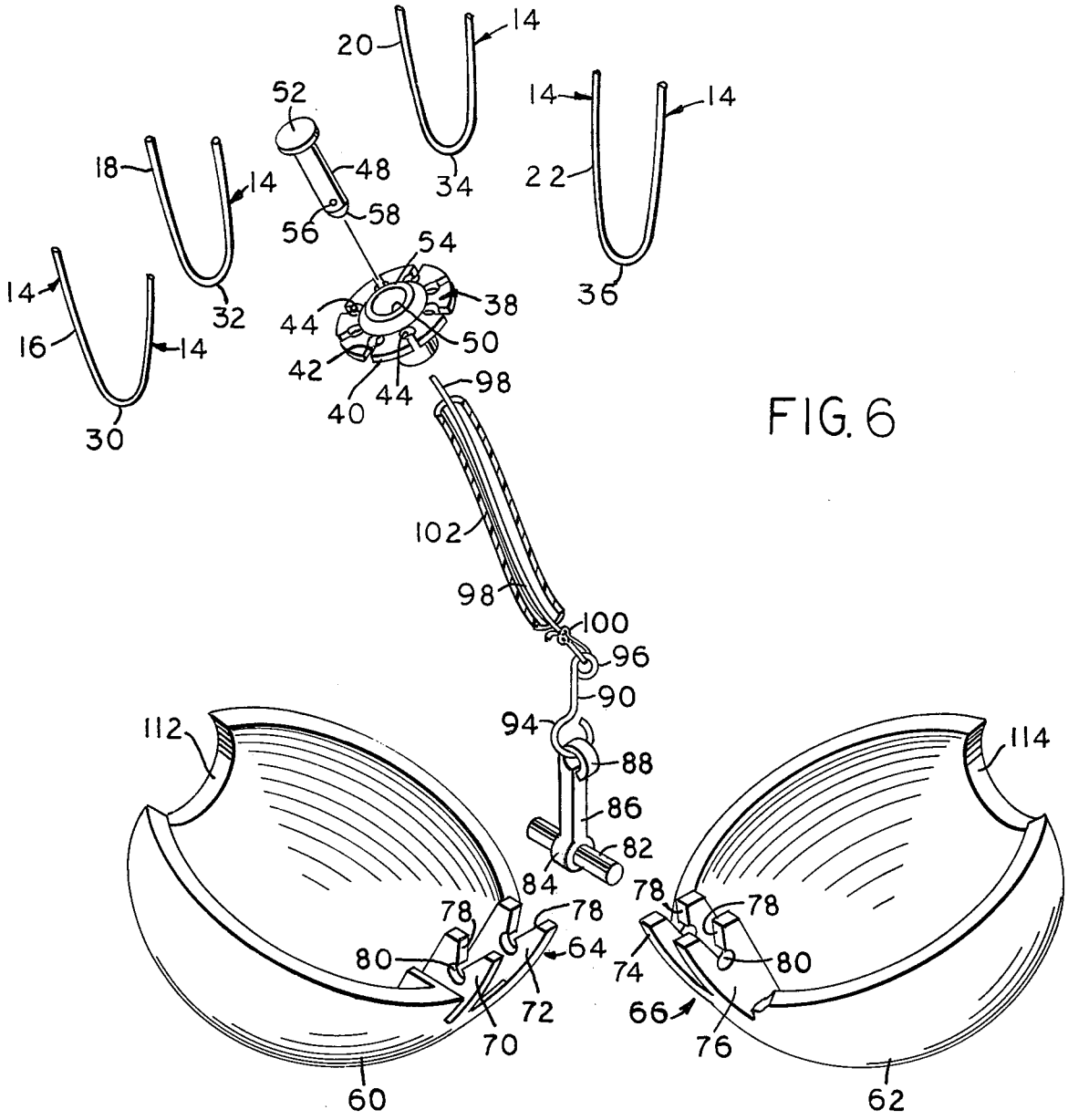
FIG. 6 is an exploded perspective view of the portion of the parachute toy shown in FIG. 4.
Figure 8:
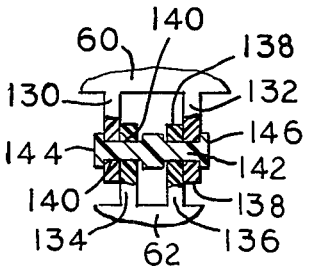
FIG. 8 is a section taken along the line 8—8 of FIG. 7.

Referring in detail to the drawings, there is shown in FIG. 1 a preferred embodiment of a parachute toy 10 made in accordance with the present invention. The parachute toy 10 includes a canopy 12, formed of fabric or other light weight flexible material such as plastic film and a plurality of shroud lines 14. By way of example, the parachute toy is illustrated as having eight shroud lines 14, these being formed of four elongated cords 16, 18, 20 and 22 (FIG. 6), each bent double to provide a pair of free ends, shown typically as ends 24 and 26 in FIG. 1, attached to the peripheral edge 28 of the canopy 12.

The cords 16, 18, 20 and 22 are substantially equally spaced on the peripheral edge 28 of the canopy 12 and are each folded to form a series of respective loops 30, 32, 34 and 36 as shown in FIG. 6. The lines 14 are mounted on a shroud plate 38 which has a substantially circular peripheral edge 40 divided by a series of equally-spaced radial slots 42, in the example illustrated, eight slots 42 being provided. The width of each slot 42 is slightly less than the diameter of the cords 16, 18, 20 and 22, and each slot terminates in a respective enlarged circular hole 44 of appreciably larger diameter than said cords. As shown in FIG. 5, the looped ends 30, 32, 34 and 36 of the respective cords 16, 18, 20 and 22 are each mounted in a pair of adjacent holes 44 by sliding these looped ends through the corresponding narrow slots 42 until the ends snap into said holes 44. The looped ends 30, 32, 34 and 36 then extend along the bottom surface 46 of the shroud plate 38 between the adjacent holes 44, as shown in FIG. 5. As a consequence of such mounting, each of the shourd lines 14 extends upwardly from one of the holes 44 of the shroud plate 38.

A cylindrical shaft 48 fits rotatably within a central bore 50 in the shroud plate 38. The shaft 48 includes an enlarged cap portion 52 which rests on the top surface 54 of the shroud plate 38 and a transverse bore 56 which extends through the bottom portion 58 of the shaft 48. The shaft 48 and the shroud plate 38 are each molded in a plastic material such as nylon having a relatively low coefficient of friction, thus facilitating the rotation of said shaft 48 relative to the shroud plate 38.

A pair of hollow hemispherical shells 60 and 62 are joined together by respective interfitting hinge sections 64 and 66 formed integrally with said shells, and when said shells 60 and 62 are closed, they form a hollow ball 68. The hinge section 64 of shell 60 includes a pair of integrally-formed projecting plates 70 and 72, while the hinge section 66 of shell 62 includes a similar pair of integrally formed projecting plates 74 and 76. The free ends of each of the projecting plates 70, 72, 74 and 76 are formed with an inwardly-converging tapered slot 78. The narrow inner end of each tapered slot 78 communicates with a circular hole 80 having a diameter slightly greater than the width of the narrow inner end of the slot 78. The holes 80 are in substantial alignment with each other, and the projecting plates 70, 72, 74 and 76 cooperate with a hinge pin 82 which fits rotatably within the aligned holes 80 to form the hinge. The projecting plates 70 and 72 of shell 60 are spaced apart a greater distance than the projecting plates 74 and 76 of shell 62 so that when the shells are assembled to form the completed ball, the pair of plates 74 and 76 fit closely within and between the pair of spaced plates 70 and 72, as best seen in FIG. 3, and the holes 80 of all of the plates are in registry.

During the assembly of the hollow ball 68, the hinge pin 82 is inserted into the tapered slots 78 of the pair of projecting plates 74 and 76 of shell 62, and is forced past the narrow inner ends of said tapered slots 78 and into the communicating holes 80, with a snap fit. The other shell 60 is then brought into registry with the shell 62, with the spaced plates 70 and 72 embracing the plates 74 and 76 and the tapered slots 78 of plates 70 and 72 receiving the mounted pin 82. The shells 60 and 62 are then pressed together, causing the pin 82 to snap past the narrow inner ends of the tapered slots 78 of plates 70 and 72 and into the communicating holes 80. The shells 60 and 62 are thus firmly joined to each other by the hinge sections 64 and 66, both of which can turn freely about hinge pin 82.

The hinge pin 82 has an integrally-formed enlarged central cylindrical portion 84 which is in turn formed integrally with a shaft 86 terminating in a closed loop 88. A wire link 90 has a looped end 94 which passes through the loop 88 of shaft 86. The other end of wire link 90 is formed into a loop 96 to which the end of a flexible cord 98 is secured by a knot 100. The cord 98 passes through an elongated, hollow flexible tube 102, and its opposite end extends through the transverse bore 56 of shaft 48 and is secured to said shaft by a knot 104.

The length of the tube 102 is slightly greater than the internal diameter of the hollow shells 60 and 62 and assists in the opening operation of the parachute toy 10 in a manner to be presently described.

Each of the shells 60 and 62 is formed with relatively large cut-away portions on either side of and between their respective hinge plates 70, 72 and 74, 76, and these cut-away portions cooperate in the assembled condition of ball 68 to form openings 106, 108 and 110 (FIG. 3) through which air may enter to the interior of the ball when the latter is thrown into the air. Diametrically opposite to the hinge sections 64 and 66, the shells 60 and 62 are provided with respective semicircular openings 112 and 114 which form a round hole 116 when the shells 60 and 62 are in the closed position shown in FIG. 2.

In use, the hollow ball 68 is initially held in the open position shown in FIG. 4 and the resilient tube 144 is first bent sufficiently to fit within the interior of the hollow ball 68 and is placed into one of the shells 60 or 62 followed by the shroud plate 38, the plurality of shroud lines 14 and finally the canopy 12 which is loosely crumpled and compressed to a size to fit within the internal volume of the hollow ball 68. The hollow ball 68 is then closed, held tightly in closed position, and thrown upwardly by the user 118 in the manner indicated in FIG. 1. The outside surface 166 of the hollow ball 68 presents relatively low aerodynamic drag and the parachute toy 10, in accordance with the present invention, can easily be thrown to a relatively great height. Heights as great as eighteen feet can easily be accomplished. The hollow ball 68 and the canopy 12 are proportioned so that the loosely crumpled canopy 12 is lightly compressed to fit the internal volume of the hollow ball 68, thus providing an expansion force tending to open the shells 60 and 62 of the hollow ball 68.

As the hollow ball 68 begins to fall, the resilience of the crumpled canopy 12 combined with the effect of air rushing into the interior of the ball through openings 106, 108 and 110, as well as opening 116, and the resilience of the bent hollow flexible tube 102, all tend to force apart the shells 60 and 62, thereby opening the hollow ball 68. As the ball opens, the expanding canopy 12 is ejected and fills with air, so that the parachute toy 10 floats slowly back to earth.

The shroud plate 38 is free to swivel with respect to the shaft 48, thus reducing the probability of tangling of the shroud lines 14. The hollow ball 68 makes it possible for a child to throw the assembled and closed parachute toy 10 to relatively great heights with the result that the length of time for the paracute to return to earth is increased considerably beyond that of conventional parachute toys. The hollow ball 68 eliminates the requirement for folding the canopy 12 tightly as in a conventional parachute toy, thus increasing the probability that the canopy will fill with air in a successful manner. The resilient tube 102 spaces the opened ball shells 60 and 62 away from the shroud lines 14 and reduces the probability of tangling of said shroud lines. In the event that the shroud lines 14 become tangled, the shroud plate 38 can be separated from the shroud lines 14 by disengaging the loops 30, 32, 34 and 36 from the shroud plate 38 by means of the radial slots 42 therein, and the shroud lines 14 can then be easily untangled.

Figure 7:
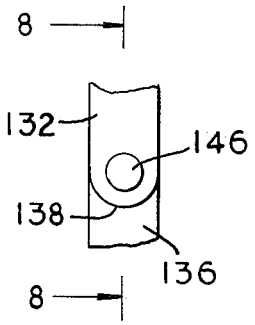
FIG. 7 is an enlarged fragmentary side elevational view of a hinge portion in a second embodiment of the invention.

In a first alternative embodiment of the invention, shown in FIG. 7, the projecting plates 70, 72, 74 and 76 are replaced by projecting plates 130, 132, 134 and 136 in which the tapered slots 78 are eliminated and which have a rounded end portion 138 provided with closed circular holes 140. The hinge pin 142 extends rotatably through the circular holes 140 and has enlarged end portions 144 and 146, formed by swaging, to prevent the removal of the hinge pin 142 from the projecting portions 130, 132, 134 and 136. In this embodiment, therefore, the hinge is a permanent assembly.

In a second embodiment of the invention, which is not shown, the shroud lines 14 are attached directly to the looped end 88 of the hinge pin shaft 86, thus eliminating the shroud plate 38, the cord 98 and the resilient tube 102. This embodiment sacrifices the advantages of the first embodiment in preventing tangling of the lines, but may be employed where economy of manufacture is of prime consideration.

While preferred embodiments of the invention have been shown and described herein, it is obvious that numerous omissions, changes and additions may be made in such embodiments without departing from the spirit and scope of the invention.

What is claimed is:

1. A parachute toy comprising a parachute canopy, a plurality of shroud lines each attached at a first end to said canopy, a hollow container sized to receive and contain said canopy in compressed condition therein, said container comprising a first hollow hemispherical shell, a second hollow hemispherical shell, and hinge means connecting said first and second hollow hemispherical shells, and means connecting the second, opposite ends of said shroud lines to the interior of said hollow container, said hinge means comprising a first pair of projecting portions integrally formed on said first hollow semispherical shell and a second pair of projecting portions integrally formed on said second hollow hemispherical shell with said first pair of projecting portions interengaging said second pair of projecting portions and with each of said projecting portions including an inwardly tapered slot and a hole disposed at the base of said slots and with said inwardly tapered slots and said holes in said projecting portions in alignment, and further comprising a hinge pin rotatably disposed passing through said holes in said projecting portions.

2. A parachute toy according to claim 1 in which said connecting means includes swivel means attached to said second ends of said shroud lines and a cord having a first end attached to said swivel means and a second end attached to said container means.

3. A parachute toy according to claim 2 in which said connecting means further includes a hollow flexible resilient tube encasing said cord.

4. A parachute toy according to claim 2 in which said swivel means includes a shroud plate having connecting means for removably attaching said shroud lines to said shroud plate, and a shaft rotatably coupled to said shroud plate.

5. A parachute toy according to claim 4 in which said connecting means on said shroud plate includes a plurality of radial slots formed in said shroud plate and in which each adjacent pair of shroud lines is formed of an elongated cord bent upon itself to provide a pair of free ends attached to said canopy, and an intermediate portion forming a loop, said shroud lines adjacent said loops extending through adjacent radial slots to remain said loops on said shroud plate.

6. A parachute toy according to claim 5 in which said shroud plate includes a plurality of holes each communicating with one of said plurality of radial slots, the width of said radial slots having slightly less than the diameter of said shroud lines, and the diameter of said holes being greater than the diameter of said shroud lines.

* * * * *